US007954605B2

(12) United States Patent
Fonteneau et al.

(10) Patent No.: US 7,954,605 B2
(45) Date of Patent: Jun. 7, 2011

(54) ELECTRIC SAFETY SWITCH RESETTING DEVICE FOR A CAR SAFETY DEVICE OF ELEVATORS

(75) Inventors: Nicolas Fonteneau, Bournan (FR); Thomas Coquerelle, Douai (FR); Franck Dominguez, Ouzouer-sur-Loire (FR); Frédéric Beauchaud, Coullons (FR)

(73) Assignee: Otis Elevator Company, Farmington, CT (US)

( * ) Notice: Subject to any disclaimer, the term of this patent is extended or adjusted under 35 U.S.C. 154(b) by 555 days.

(21) Appl. No.: 12/089,629

(22) PCT Filed: Sep. 9, 2005

(86) PCT No.: PCT/IB2005/002756

§ 371 (c)(1),
(2), (4) Date: Apr. 9, 2008

(87) PCT Pub. No.: WO2007/029049

PCT Pub. Date: Mar. 15, 2007

(65) Prior Publication Data

US 2010/0078268 A1 Apr. 1, 2010

(51) Int. Cl.
*B66B 13/14* (2006.01)

(52) U.S. Cl. ..... 187/314; 187/306

(58) Field of Classification Search ..... 187/277, 187/279, 288, 293, 313, 373, 391–393, 414, 187/306–311, 314

See application file for complete search history.

(56) References Cited

U.S. PATENT DOCUMENTS

| | | | | |
|---|---|---|---|---|
| 1,864,588 | A * | 6/1932 | Dunlop | 187/373 |
| 2,015,860 | A * | 10/1935 | May | 242/585 |
| 2,182,036 | A * | 12/1939 | Rainey | 187/314 |
| 6,173,813 | B1 | 1/2001 | Rebillard et al. | |
| 7,073,632 | B2 * | 7/2006 | Martin | 187/288 |
| 7,097,003 | B2 * | 8/2006 | Reynolds et al. | 187/351 |
| 7,237,655 | B2 * | 7/2007 | Kocher | 187/314 |
| 7,299,898 | B2 * | 11/2007 | Husmann | 187/373 |
| 7,650,971 | B2 * | 1/2010 | Pillin et al. | 187/331 |
| 2009/0321192 | A1 * | 12/2009 | Kattainen et al. | 187/279 |

FOREIGN PATENT DOCUMENTS

| | | | |
|---|---|---|---|
| CN | 2517715 | Y | 10/2002 |
| EP | 0806394 | A1 | 11/1997 |
| GB | 671286 | | 4/1952 |
| JP | 54138259 | A * | 10/1979 |

* cited by examiner

*Primary Examiner* — Jonathan Salata
(74) *Attorney, Agent, or Firm* — Carlson, Gaskey & Olds PC

(57) ABSTRACT

An electric safety switch (3) resetting device (1) for the car safety device (5) of elevators includes a switch (3) shaped as a box attached to the lower skirt (9) of the car frame, near the car safety blocks (11). A mobile upper tongue (13) is engaged with a car safety block triggering lever (15), which tongue (13) can trigger the switch (3) under the action of said triggering lever (15) and reset it in the opposite direction when operated by the maintenance operator. A connecting rod arrangement (29) hinged to the tongue (13) can be remotely actuated by the operator using an actuator (35) while standing at the landing opening near the arrested elevator car, to drive said tongue (13) to a position that will reset the switch (3).

8 Claims, 4 Drawing Sheets

ELECTRIC SAFETY SWITCH RESETTING DEVICE FOR A CAR SAFETY DEVICE OF ELEVATORS

BACKGROUND

This invention relates to an electric safety switch resetting device for a car safety device of elevators.

It is known that the safety switch of the elevator car safety device is located near the car's safety blocks at the level of the lower end of the car frame. An actuation rod mechanism is connected to the switch to enable its reset by the operator as soon as the switch has been triggered, from the roof of the car or the floor of the shaft. However, such actuation by the operator entails some risks and the actuation rod mechanism is difficult to install because there is little available space on the side of the car.

SUMMARY

This invention aims at solving these disadvantages and proposes an electric safety switch resetting device for a car safety device of elevators, wherein the switch is attached to a car frame, the resetting device comprising a mobile upper tongue engaged with a car safety block triggering lever, the tongue is configured to trigger the switch under the action of the triggering lever and reset the switch in an opposite direction when operated by an operator, characterized in that the resetting device comprises a connecting rod arrangement hinged to the tongue, an actuator in operable communication with the connecting rod arrangement, the actuator is accessible from an elevator landing.

The rod arrangement advantageously comprises a base mounted adjacent to the switch and includes a connecting rod hinged to the base substantially in its middle part so that one end thereof engages the switch tongue to reset the switch and the opposite end is in operable communication with the actuator.

The switch is advantageously mounted on the base of the connecting rod arrangement, and the base is attached to the car frame or to the skirt of the car frame.

Said base has two upper flanges between which said connecting rod is mounted to rotate on an axis attached to the two flanges and a lower base with opposing side parts forming end stops for the connecting rod, respectively in a resting position of the tongue (triggered) and in a resetting position of the tongue (raised).

Said actuator advantageously includes a sheathed cable connected at one end to a connecting rod drive end and an opposing end supported by a retaining plate mounted to a front lower foot guard plate of the car frame, which end can be reached by the operator from the landing opening.

The actuator can include a cable connected to a spring.

Said engagement of the tongue by the connecting rod is provided by a simple side stop of the connecting rod in contact with the tongue, e.g. the shaft of a screw attached to the end of the connecting rod.

The resetting device further comprises a spring connected to the connecting rod, the spring located between the drive end of the connecting rod and a support part of the base, wherein the spring is configured to return the connecting rod to its resting position by returning to an extended position after the cable has been taut and the connecting rod driven to reset the switch.

The result of this arrangement is that after the safety switch of the car safety device has been triggered to arrest the elevator car in the shaft, the operator must no longer access the car roof or the shaft floor, according to the car's arresting position, but simply open the landing door nearest to the car (the lower skirt thereof) and actuate the actuator or the connecting rod traction cable using the corresponding button from the landing opening, without any risk of accident in that position, to reset the safety switch.

BRIEF DESCRIPTION OF THE DRAWINGS

The invention is illustrated below with an exemplary embodiment, referring to the appended figures in which.

DETAILED DESCRIPTION

Figure 1:
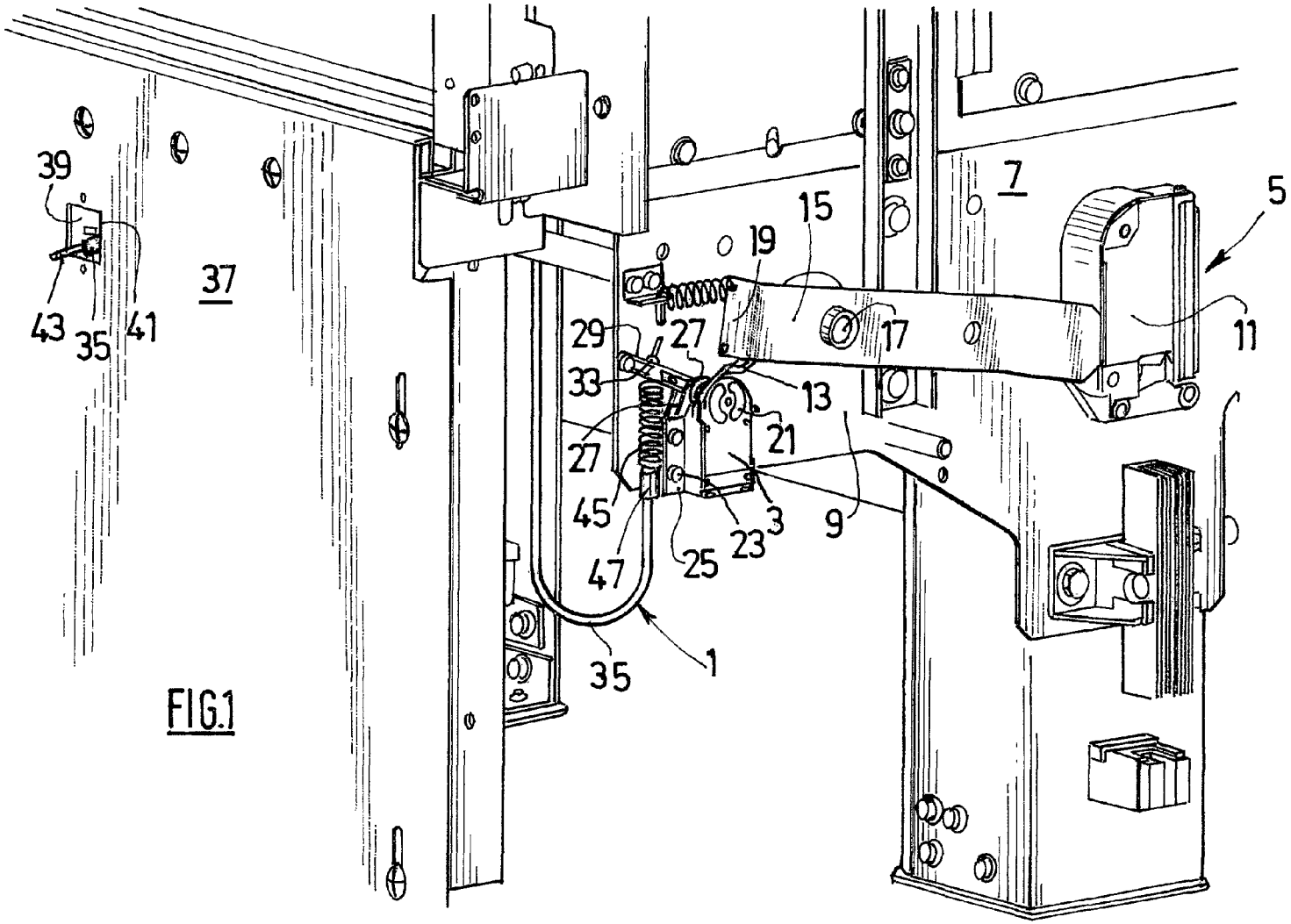
FIG. 1 is a general view of a resetting device for the safety switch of an elevator car safety device as per the invention, mounted on the elevator car.

The resetting device 1 of the safety switch 3 for the car safety device 5 of an elevator car 7 as per the invention uses a conventional safety switch 3 designed as a box attached to the lower skirt 9 of the elevator car near a car safety block 11 that is engaged on a car guide rail (not represented).

This switch 3 comprises a triggering tongue 13 that stands out laterally from the top of the switch and is located close beneath the end of a triggering lever 15 of the car safety block 11. This triggering lever 15 is pivotally mounted on a transverse axis 17 close to its upper end and tilts when arresting the elevator car to engage the tongue 13 with its end 19 and turn it downwards, while at the same time turning the rotary contact ring 21 to which the tongue is attached into an off-circuit or off-supply position.

The switch is attached by screws 23 to a flat vertical base 25 that is also screwed to the car skirt 9.

Figure 2:
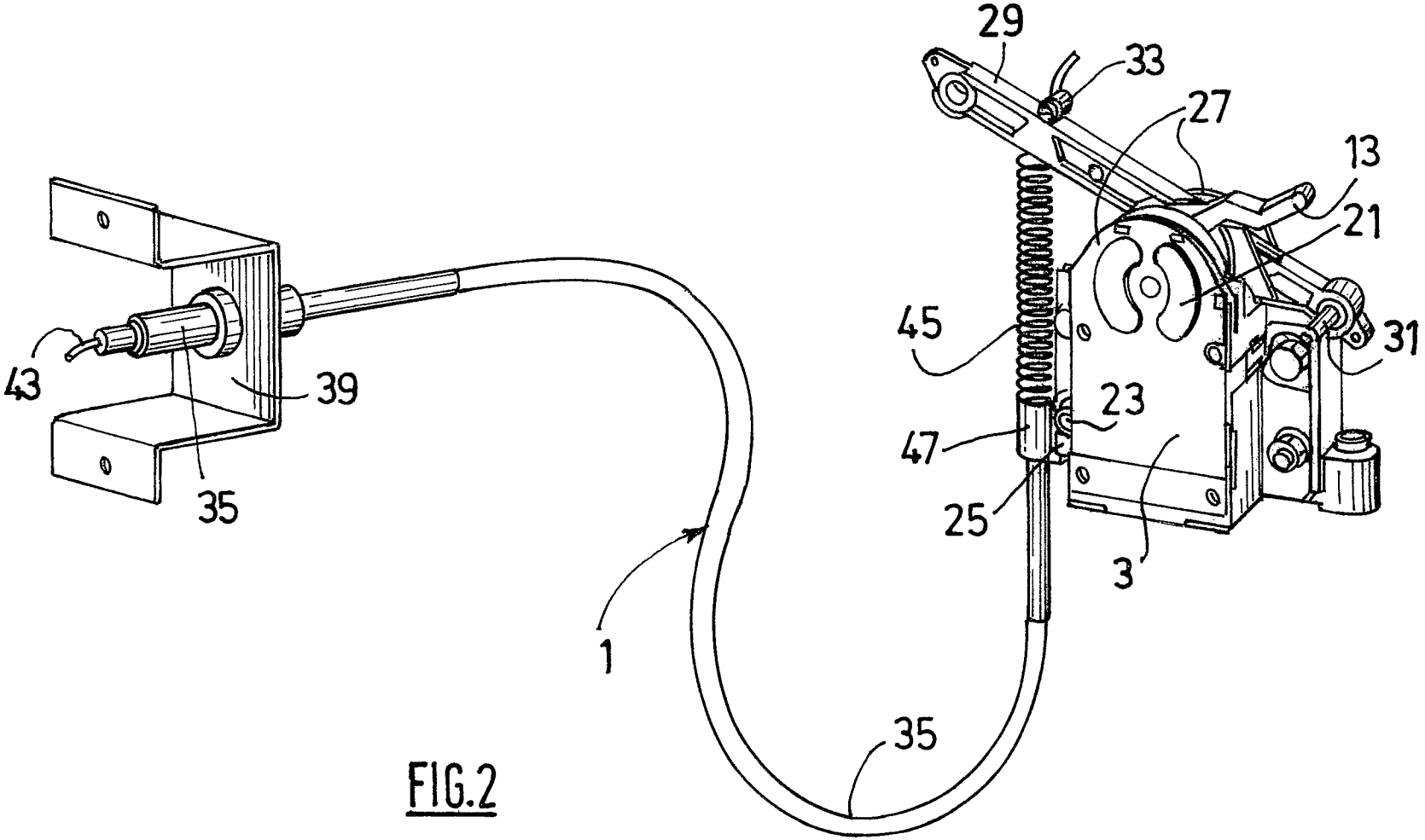
FIG. 2 is a perspective view of the resetting device alone.

This base 25 has two upper flanges 27 between which a connecting rod 29 is mounted to rotate on a median upper transverse axis attached to the two flanges 27. This connecting rod 29 is hinged in its middle part, bearing a side stop 31 shaped as a rod at one of its ends, turned towards the tongue 13, under it, thanks to which it can raise the tongue 13 after the latter has descended to the lower level on safety triggering, and an opposite driven end 33 connected to a sheathed traction cable 35 and having an end connected to the front foot guard plate 37 of the car by means of a holding plate 39 (FIG. 2) attached to said plate 37.

The holding plate 39 is arranged at the level of a lumen 41 cut out in the plate to expose the end 43 of the cable, which can be pulled by means of pliers. This end can also bear a control switch.

A helical spring 45 is mounted between the end connecting the cable 35 to the connecting rod 29 and a lower support 47 integral with the base 25, wherein the spring 45 is advantageously held in line by the cable 35 threaded between its turns.

The spring 45 pushes the connecting rod 29 upwards after the cable 35 has been pulled at its free end, so that the end of the connecting rod turned towards the tongue returns downwards, releases the tongue to move downwards and allows lifting it with its side stop 31 to be reset upwards when the cable is pulled.

The lower part of the base 25 has two lower stop surfaces 49, 51 for the connecting rod, opposed laterally and on which the connecting rod 29 abuts respectively after a resetting pull or in the lifted off-service return position.

The operation shall now be described.

Figure 3:
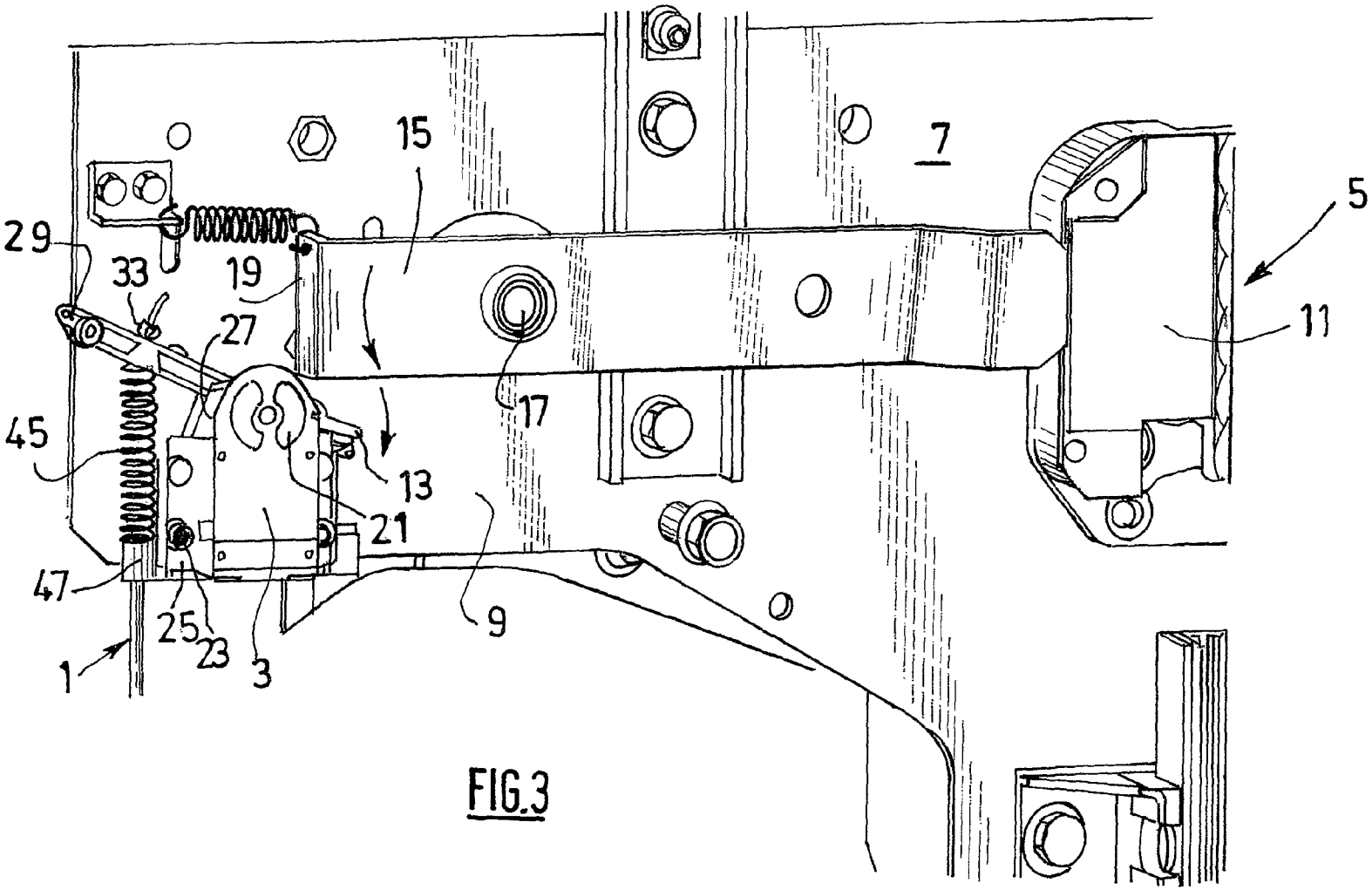
FIG. 3 is a view of the safety switch being triggered by the car safety block lever.

Assuming that the car safety block is actuated, e.g. in case of car 7 overspeed, the car then is arrested on its guide rails and the triggering lever 15 tilts (FIG. 3) to push down the tongue 13 of the safety switch by rotating, engaging the tongue with its outer end around its axis.

The tongue 13 is then lowered so that the switch 3 is switched off and power supply cut off.

The maintenance operator must then release the car to allow the triggering lever 15 of the car safety block to be lifted and to reset the safety switch after correcting the failure.

Figure 4:
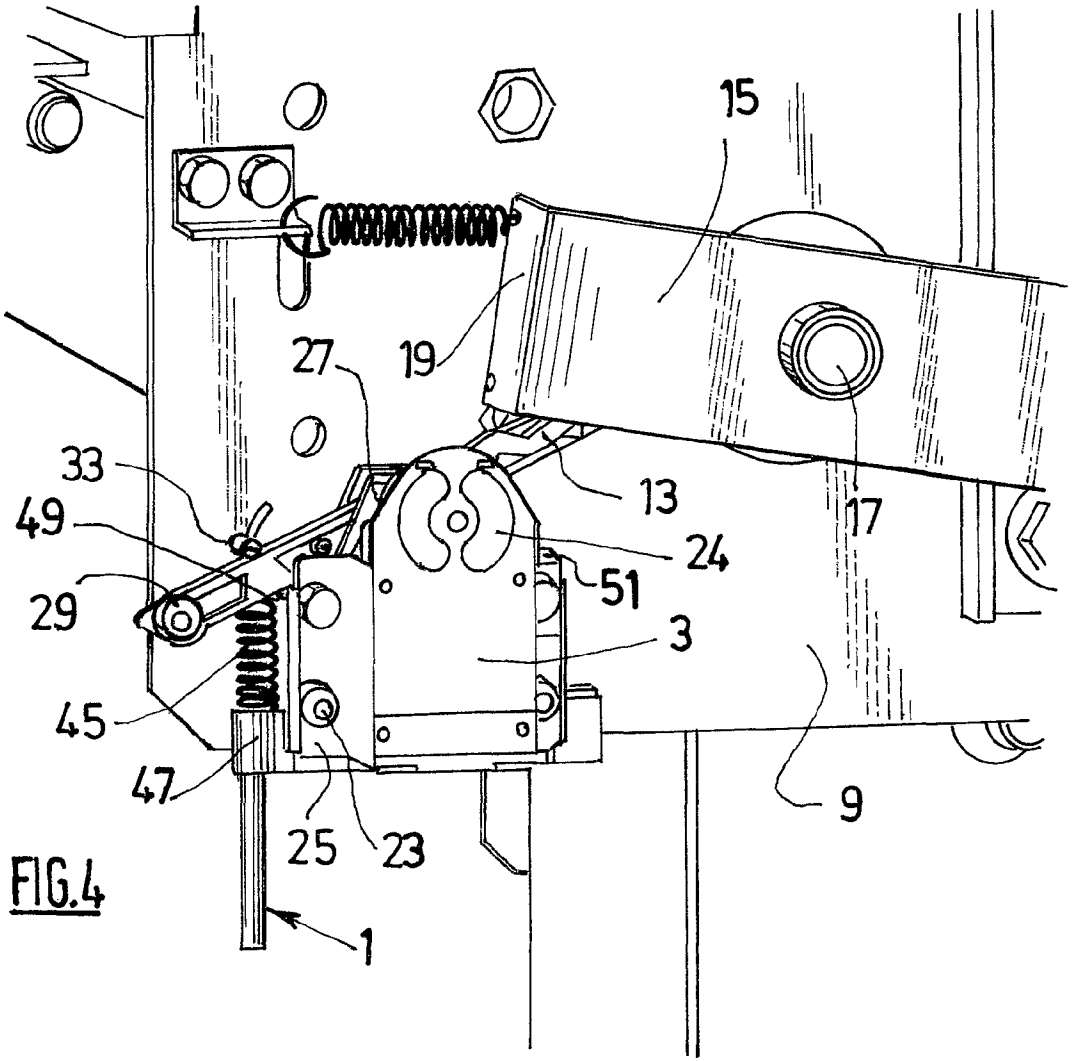
FIG. 4 shows the switch being reset by the resetting device as per the invention.

At that time, the operator opens the landing door near the car skirt 9. He then simply pulls the end 43 of the cable using pliers to the end of its travel (FIG. 4) in order to let the connecting rod 29 abut against the corresponding stop surface 49 of the base. The tongue 13 is then raised and the switch 3 is reset. This operation from a landing opening does not entail any risk.

The invention claimed is:

1. Electric safety switch resetting device for a car safety device of elevators, wherein the switch is attached to a car frame, the resetting device comprising a mobile upper tongue engaged with a car safety block triggering lever, the tongue is configured to trigger the switch under the action of the triggering lever and reset the switch in an opposite direction when operated by an operator, the resetting device comprises a connecting rod arrangement hinged to the tongue, an actuator in operable communication with the connecting rod arrangement, the actuator is accessible from an elevator landing.

2. Resetting device as per claim 1, characterized in that the connecting rod arrangement comprises a base mounted adjacent to the switch and includes a connecting rod hinged to the base at a center section so that one end thereof engages the tongue to reset the switch and an opposite end is in operable communication with the actuator.

3. Resetting device as per claim 2, characterized in that the switch is mounted on the base of the connecting rod arrangement, and the base is attached to the car frame.

4. Resetting device as per claim 2, characterized in that the base has two upper flanges between which the connecting rod is mounted to rotate on an axis attached to the two flanges and a lower base with opposing side parts forming end stops for the connecting rod, respectively in a resting position of the tongue and in a resetting position of the tongue.

5. Resetting device as per claim 1, characterized in that the actuator includes a sheathed cable connected at one end to a connecting rod drive end and an opposing end supported by a retaining plate mounted to a front lower foot guard plate of the car frame, which end can be reached by the operator from the landing opening.

6. Resetting device as per claim 1, characterized in that the engagement of the tongue by the connecting rod is provided by a simple side stop of the connecting rod in contact with the tongue.

7. Resetting device as per claim 5, characterized in that the resetting device further comprises a spring connected to the connecting rod, the spring located between the drive end of the connecting rod and a support part of the base, wherein the spring is configured to return the connecting rod to its resting position by returning to an extended position after the cable has been taut and the connecting rod driven to reset the switch.

8. Resetting device as per claim 1, wherein the actuator includes a cable connected to a spring.

* * * * *